United States Patent [19]

Rosenberg

[11] 4,070,780

[45] Jan. 31, 1978

[54] MULTIPLE PICTURE FRAME

[76] Inventor: Harry W. Rosenberg, 8941 Roosevelt Blvd., Philadelphia, Pa. 19152

[21] Appl. No.: 735,467

[22] Filed: Oct. 26, 1976

[51] Int. Cl.[2] ..... G09F 1/12

[52] U.S. Cl. ..... 40/152

[58] Field of Search ..... D6/232, 234, 239, 240; 40/152, 64, 152.1

[56] References Cited

U.S. PATENT DOCUMENTS

| | | | |
|---|---|---|---|
| D. 22,392 | 5/1893 | Reinfeld | D6/234 |
| D. 35,926 | 5/1902 | Gould | D6/234 |
| D. 138,504 | 8/1954 | Cirkinian | D6/234 |
| 1,464,099 | 8/1923 | Herlihy | 40/64 |
| 2,504,375 | 4/1950 | Barbieri | 40/152.1 |
| 3,471,959 | 10/1969 | Seger | 40/152 |

*Primary Examiner*—Louis G. Mancene
*Assistant Examiner*—Wenceslao J. Contreras
*Attorney, Agent, or Firm*—Seidel, Gonda & Goldhammer

[57] ABSTRACT

First and second sets of U-shaped border members are connected to a common central border member at offset locations to define at least two picture openings offset from one another.

10 Claims, 5 Drawing Figures

MULTIPLE PICTURE FRAME

BACKGROUND

Multiple picture frames are classifiable in class 40/152. Representative prior art is neglected by U.S. Pat. Nos. 2,218,409; 3,673,724; 3,611,604. Multiple prior art picture frames provide picture openings which are alongside one another or disposed one above the other while using more material than is absolutely necessary.

There is a need for a multiple picture frame having offset picture openings so that picture sets such as mother-daughter, father-son, husband-wife, etc. may be portrayed together in a manner which is attractive and distinctive.

SUMMARY OF THE INVENTION

The multiple picture frame of the present invention is comprised of at least two peripheral border members which are generally U-shaped and a common central border member. The free ends of each set of border members are connected to said common central border member but are offset from one another to define at least two picture openings which likewise are offset from one another. The picture frames may be of the self-supporting type or may be of the wall mounted type.

It is an object of the present invention to provide a novel multiple picture frame having at least two rectangular picture openings offset from one another and adapted to self-supported or wall mounted.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown in FIG. 1 a multiple picture frame in accordance with the present invention designated generally as 10.

The multiple picture frame 10 may be made from a wide variety of materials. In accordance with the preferred embodiment, the multiple picture frame 10 is made from wood. The frame 10 includes a first set of U-shaped border members defined by border members 12, 14 and 16 and a second set of U-shaped border members defined by members 18, 20 and 22. The free ends of members 12, 16, 18 and 22 are connected to a common central border member 24.

Figure 2:
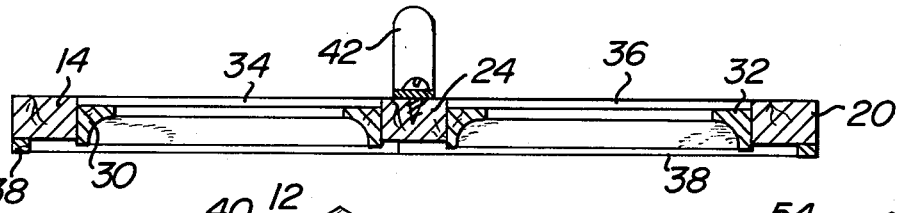
FIG. 2 is a sectional view taken along the line 2—2 in FIG. 1.

The central border member 24 is longer than any of the remaining border members. Each of the sets of border members are of the same size. Border member 12 is connected to one end of border member 24. Border member 22 is connected to the opposite end of central border member 24. Hence, the border members 12–24 cooperate with one another to define rectangular offset picture openings 26 and 28. A scalloped molding 30 is provided around the entire inner periphery of opening 26. A similar molding 32 is provided around the periphery of opening 28. As shown more clearly in FIG. 2, the moldings 30, 32 have the same thickness as the border members 12–24 but are offset from one another so as to define recesses 34, 36 for receiving a picture. Each of the border members 12–24 has the same width and thickness.

Figure 1:
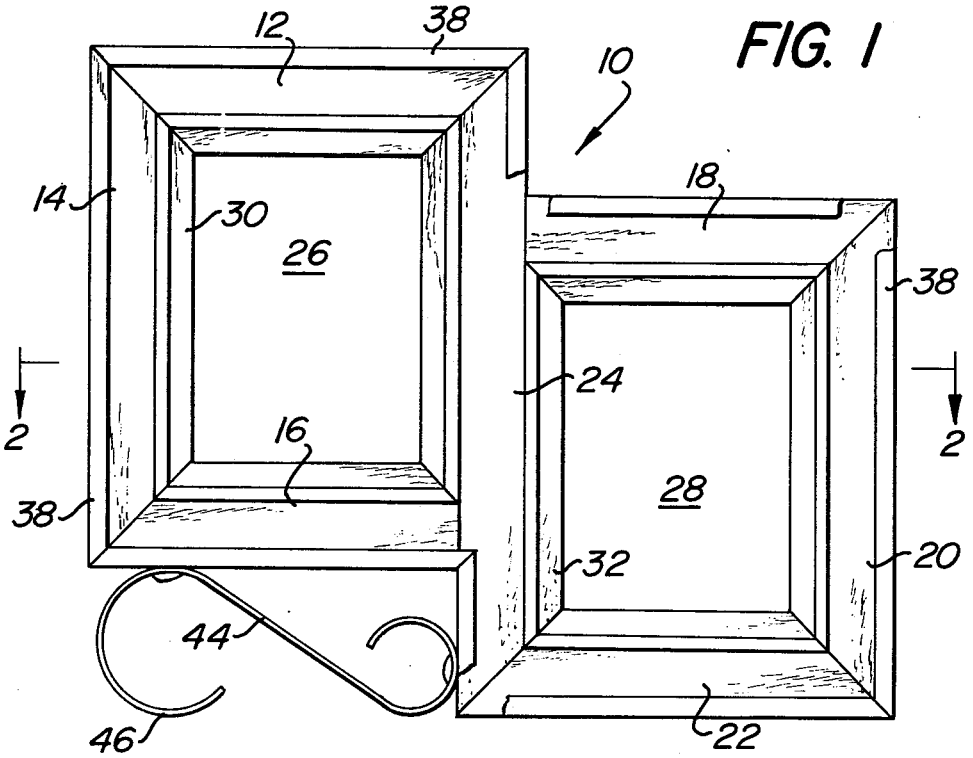
FIG. 1 is a front elevation view of a multiple frame in accordance with one embodiment of the present invention.

A decorative trim 38 is secured to the front surface of each of the border members 12–16 and 18–22. Trim 38 overlies a portion of border member 24 adjacent opposite ends thereof. In FIG. 1, portions of the trim 38 have been broken away to illustrate miter joints between the borders members 12–24. The components of the frame 10 may be secured together using conventional fasteners and/or adhesives. As shown more clearly in FIG. 2, the trim 38 has a thickness greater than the amount by which the moldings 30, 32 project beyond the front face of the border members 12–24.

The central border member 24, on its rear face, has a picture hook 40 attached thereto to facilitate supporting the frame 10 on a wall. Also, a support bracket 42 is removably secured to the central border member 24 on its rear surface by way of threaded fasteners to facilitate supporting the picture frame 10 on a surface such as a desk. When using the picture hook 40, it is necessary to remove the threaded fasteners and bracket 42. If desired, a decorative spacer 44 may be attached to the border member 16 and/or border member 24. As illustrated, the spacer 44 is a generally S-shaped metal band. Point 46 on spacer 44 lies in the same plane as the bottom edge of border member 22. The spacer 44 is optional and when present will be utilized regardless of whether the frame 10 is self-supporting by way of bracket 42 or hung on a wall by way of picture hook 44.

While the frame 10 as illustrated contains only two picture openings, a larger number of openings may be provided by attaching another U-shaped set of border members to provide a third opening offset with respect to opening 26. In connection with such alternatives, border member 14 will be elongated to the same length as border member 24.

Figure 4:
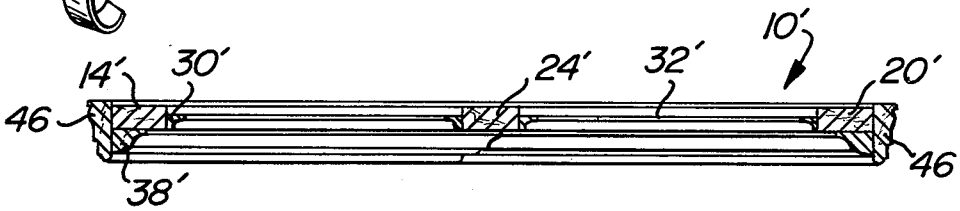
FIG. 4 is a sectional view similar to FIG. 2 but illustrating another embodiment of the present invention.

In FIG. 4, there is illustrated a sectional view, similar to FIG. 1, but of another embodiment of a picture frame designated generally as 10'. The picture frame 10' is identical with picture frame 10 except as will be made clear hereinafter. Hence, corresponding elements are provided with corresponding primed numerals.

In picture frame 10', the trim 38' is of a different shape. Also, a border trim 46 is provided. The border trim 46 has a height greater than the combined height of the border members and trim 38'. Also, the border trim 46 completely encircles the periphery of the frame 10'.

Figure 3:
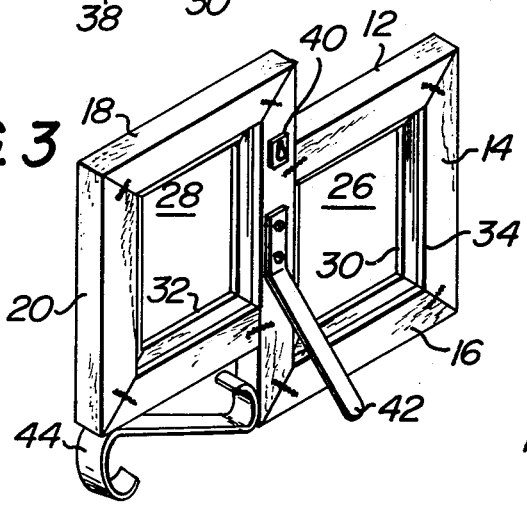
FIG. 3 is a rear perspective view, on a smaller scale, of a picture frame similar to that shown in FIG. 1.
Figure 5:
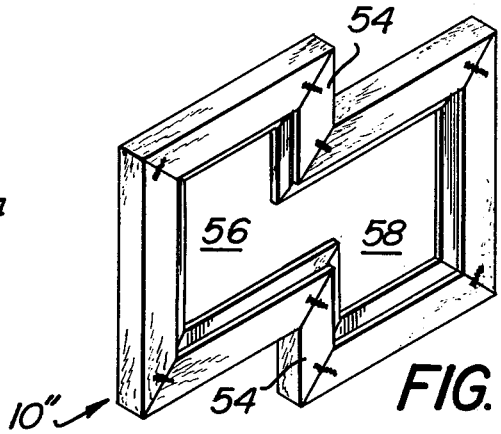
FIG. 5 is a perspective view of an alternative embodiment.

In FIG. 5, there is shown an alternative frame designated 10''. Frame 10'' is the same as frame 10 as shown in FIG. 3 except as follows. In frame 10'', the central portion of the central border member 54 is eliminated whereby the two rectangular picture openings are contiguous. A single sheet having the combined shape of openings 56, 58 may be used with or without a mat. If a mat is used, it may have a central border which is aligned with the central borders 54. The single sheet may have two pictures thereon with each picture positioned for exhibition by way of one of the openings 56, 58. Frame 10'' does not have a spacer corresponding to spacer 44. Frame 10'' is otherwise the same as frame 10.

The present invention may be embodied in other specific forms without departing from the spirit or essential attributes thereof and, accordingly, reference should be made to the appended claims, rather than to the foregoing specification as indicating the scope of the invention.

I claim:

1. A multiple picture frame comprising first and second sets of peripheral border members and a common central border member all having a major face lying in a common plane, each set of border members being U-shaped with each of its ends connected to said central border member, one of the legs of each set of border members being longer than the other leg and generally perpendicular to said central border member, said sets of border members being vertically offset from each other to define at least two picture openings offset from one another, a molding secured to the inner periphery of each set of border members, each set of molding being offset with respect to a rear face of said border members to define a picture recess slightly larger than said picture openings, a means on the rear face of said frame to facilitate mounting the frame.

2. A multiple picture frame in accordance with claim 1 including trim connected to the periphery of said sets of border members, and a portion of said trim being connected to diametrically opposite end portions of said central border member.

3. A multiple picture frame in accordance with claim 1 including a border trim around the periphery of said border members, the height of the trim being greater than the thickness of said border members.

4. A multiple picture frame in accordance with claim 1 including a decorative spacer attached to one border member and providing a contact surface in the same plane as the lower edge of an adjacent parallel border member.

5. A multiple picture frame comprising a common central border member, first and second sets of peripheral border members each having two spaced ends, said sets being on opposite sides of said central border member and offset with respect to one another, the ends of each set being connected to said central border member and cooperating therewith to define two picture openings offset from one another, each set of peripheral border members having a component parallel to but shorter in length than the common central border member, means connected to a rear face of said central border member to facilitate mounting the frame, trim secured to a peripheral portion of each of the sets of border members, said trim being connected to oppositely disposed side end portions of said common central border member so as to form a continuation of the trim around the entire periphery of the frame, and means defining a recess on the rear surface of said frame which is larger than and coextensive with each of said openings.

6. A multiple picture frame in accordance with claim 5 wherein said last-mentioned means includes a molding attached to the inner periphery of each set of peripheral border members and to opposite sides of said common central border member.

7. A multiple picture frame in accordance with claim 5 wherein each of said peripheral borders has the same width as said central border member.

8. A multiple picture frame in accordance with claim 5 wherein each peripheral border has a major face lying in common plane with a major face of said central border member.

9. A multiple picture frame in accordance with claim 5 including a border trim extending entirely around the periphery of said frame and having a height greater than the thickness of each border member.

10. A multiple picture frame in accordance with claim 1 wherein said central border member is in two pieces separated by a gap which interconnects said picture openings.

* * * * *